US010918148B2

(12) United States Patent
Brandt et al.

(10) Patent No.: US 10,918,148 B2
(45) Date of Patent: Feb. 16, 2021

(54) SLEEVE CONSTRUCTION FOR A GARMENT

(71) Applicant: NIKE, Inc., Beaverton, OR (US)

(72) Inventors: Baron C. Brandt, Portland, OR (US); Karey Cruz, Portland, OR (US)

(73) Assignee: NIKE, INC., Beaverton, OR (US)

( * ) Notice: Subject to any disclaimer, the term of this patent is extended or adjusted under 35 U.S.C. 154(b) by 46 days.

(21) Appl. No.: 15/960,013

(22) Filed: Apr. 23, 2018

(65) Prior Publication Data

US 2018/0343942 A1 Dec. 6, 2018

Related U.S. Application Data

(60) Provisional application No. 62/512,309, filed on May 30, 2017.

(51) Int. Cl.

| | |
|---|---|
| ***A41D 27/10*** | (2006.01) |
| ***A41D 27/20*** | (2006.01) |
| ***A41D 1/02*** | (2006.01) |
| ***A41D 1/04*** | (2006.01) |
| ***A41D 13/08*** | (2006.01) |

(52) U.S. Cl.

CPC ..... *A41D 27/10* (2013.01); *A41D 1/02* (2013.01); *A41D 1/04* (2013.01); *A41D 13/081* (2013.01); *A41D 27/20* (2013.01)

(58) Field of Classification Search

CPC ..... A41D 27/10; A41D 27/20; A41D 1/02; A41D 3/00

USPC ..... 2/93, 94, 247, 248

See application file for complete search history.

(56) References Cited

U.S. PATENT DOCUMENTS

| | | | | |
|---|---|---|---|---|
| 1,092,047 A | | 3/1914 | Hertz | |
| 2,274,510 A | | 2/1942 | Wohl et al. | |
| 2,841,794 A | | 7/1958 | De Grazia | |
| 2,928,101 A | | 3/1960 | Kennedy | |
| 3,193,842 A | * | 7/1965 | Bell | A41D 27/20 2/94 |

(Continued)

FOREIGN PATENT DOCUMENTS

| | | |
|---|---|---|
| GB | 645570 A | 11/1950 |
| GB | 2462477 A | 2/2010 |

(Continued)

OTHER PUBLICATIONS

"Cabela's men's waterfowler sweater with 4MOST windshear," Cabela's, cabelas.com, accessed: Apr. 2017. http://www.cabelas.com/product/CabelasMensWaterfowlerSweaterwithMOSTWINDSHEAR/1614527.uts.

(Continued)

*Primary Examiner* — Jillian K Pierorazio

(74) *Attorney, Agent, or Firm* — Shook, Hardy & Bacon L.L.P.

(57) ABSTRACT

Aspects herein disclose a sleeve construction for a garment comprising a right sleeve with a first pocket located superior to an elbow area of the sleeve. The pocket opening of the first pocket is positioned on an anterior aspect of the right sleeve and the pocket space extends across the anterior aspect of the right sleeve. The garment further comprises a left sleeve having a second pocket located superior to an elbow area of the left sleeve. The pocket opening of the second pocket is positioned on a medial aspect of the left sleeve and the pocket space extends across the posterior aspect of the left sleeve.

16 Claims, 5 Drawing Sheets

(56) References Cited

U.S. PATENT DOCUMENTS

| | | | | |
|---|---|---|---|---|
| 3,214,771 | A | 11/1965 | Treiber | |
| 4,275,468 | A * | 6/1981 | Outlaw | A41D 27/20 2/115 |
| 4,980,929 | A | 1/1991 | Long | |
| 5,845,336 | A * | 12/1998 | Golde | A41D 27/28 2/93 |
| 5,953,758 | A | 9/1999 | Foster | |
| 6,076,189 | A | 6/2000 | Christman et al. | |
| 6,253,379 | B1 * | 7/2001 | Collier | A41D 3/02 2/108 |
| 6,839,911 | B1 | 1/2005 | Mathews | |
| 6,996,847 | B2 | 2/2006 | Anderson et al. | |
| 7,653,949 | B2 | 2/2010 | Kraus et al. | |
| 8,613,112 | B2 | 12/2013 | Santucci et al. | |
| 8,661,563 | B2 * | 3/2014 | Evans | A41D 13/08 2/16 |
| 8,856,965 | B1 | 10/2014 | Theofield | |
| D843,690 | S * | 3/2019 | Edmiston | D2/839 |
| 2001/0025384 | A1 * | 10/2001 | Kester | A41D 15/04 2/89 |
| 2002/0095712 | A1 * | 7/2002 | Fayle | A41D 3/00 2/84 |
| 2003/0126675 | A1 * | 7/2003 | Blauer | A41D 3/00 2/456 |
| 2004/0055069 | A1 * | 3/2004 | Fayle | A41D 3/00 2/93 |
| 2004/0133962 | A1 * | 7/2004 | Baumel | A41D 27/28 2/108 |
| 2005/0015844 | A1 * | 1/2005 | Parsons | A41D 3/00 2/94 |
| 2007/0000030 | A1 * | 1/2007 | Toomey | A41D 1/04 2/247 |
| 2008/0040832 | A1 * | 2/2008 | Bay | A41D 27/28 2/93 |
| 2010/0299798 | A1 * | 12/2010 | Fayle | A41F 19/005 2/69 |
| 2010/0320241 | A1 * | 12/2010 | Thompson | A41D 15/04 224/153 |
| 2012/0060256 | A1 * | 3/2012 | Parker | A41D 3/02 2/85 |
| 2012/0204313 | A1 * | 8/2012 | Evans | A41F 5/00 2/70 |
| 2014/0096305 | A1 * | 4/2014 | Friesen | A41D 3/00 2/84 |
| 2016/0270728 | A1 * | 9/2016 | McGinnis | A62B 17/006 |
| 2016/0366953 | A1 | 12/2016 | Watts | |

FOREIGN PATENT DOCUMENTS

| | | | |
|---|---|---|---|
| JP | 3127897 | U | 12/2006 |
| WO | 2008133856 | A1 | 11/2008 |
| WO | 2009088395 | A1 | 7/2009 |

OTHER PUBLICATIONS

"Sweater with handwarmer (allsquareknits)," love knitting, loveknitting.com, accessed: Apr. 2017. https://www.loveknitting.com/us/sweater-with-handwarmer-allsquareknits-knitting-pattern-by-pat-watson.

"613027 Men's Icelandic Wool Sweater with HandWarmer Pocket," Scott's Sweaters, scottssweaters.com, accessed: Apr. 2017. http://www.scottssweaters.com/600/613/613027.htm.

International Search Report and Written Opinion dated Aug. 14, 2018 in International Patent Application No. PCT/US2018/034055, 17 pages.

International Preliminary Report on Patentability dated Dec. 12, 2019 in International Patent Application No. PCT/US2018/034055, 11 pages.

* cited by examiner

SLEEVE CONSTRUCTION FOR A GARMENT

CROSS-REFERENCE TO RELATED APPLICATIONS

This application entitled "Sleeve Construction for a Garment," claims the benefit of priority of U.S. Prov. App. No. 62/512,309, entitled "Sleeve Construction for a Garment," and filed May 30, 2017. The entirety of the aforementioned application is incorporated by reference herein.

TECHNICAL FIELD

Aspects herein disclose a sleeve construction for a garment that facilitates a wearer positioning their arms in a secure position across the wearer's chest while resting.

BACKGROUND

Long-sleeved shirts or garments are typically used to protect the wearer's arms from the elements and to provide warmth.

BRIEF DESCRIPTION OF THE DRAWINGS

Examples of the present invention are described in detail below with reference to the attached drawing figures, wherein.

DETAILED DESCRIPTION

Figure 1:
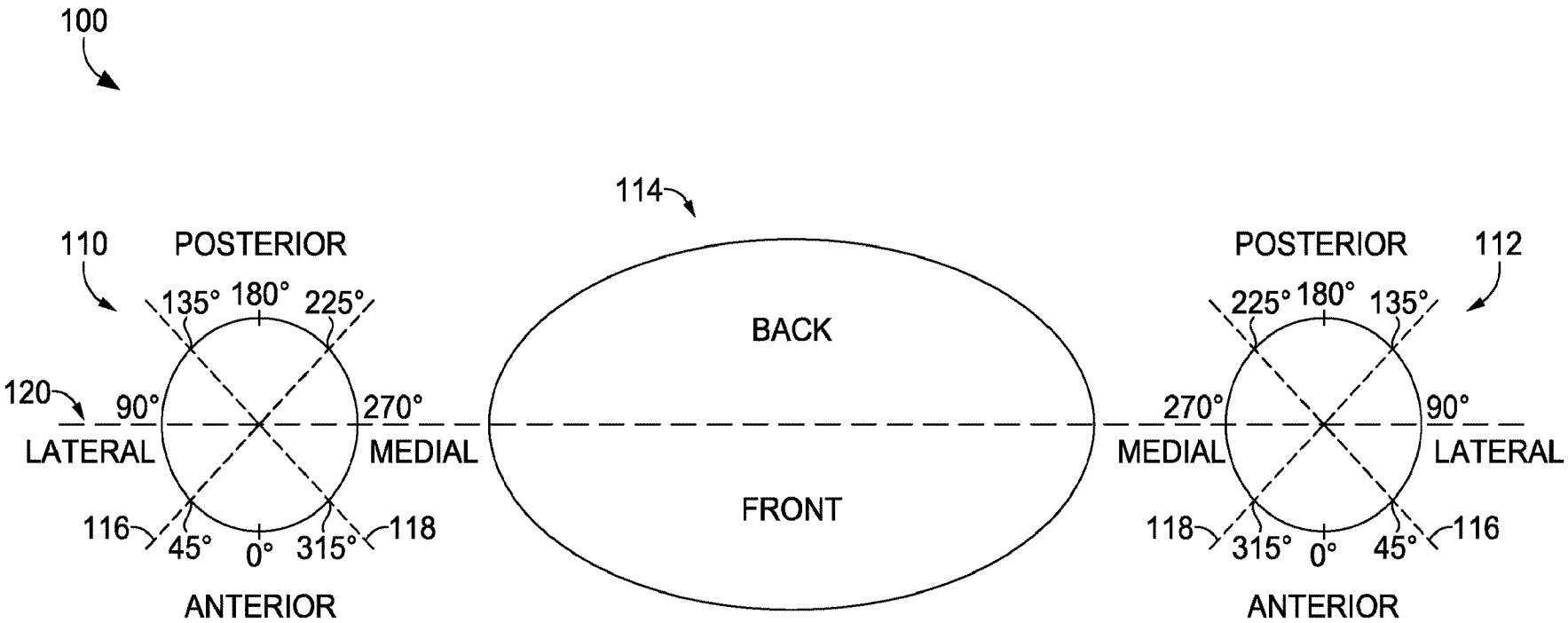
FIG. 1 illustrates a cross-sectional view of sleeve portions and a torso portion of a garment to indicate reference lines and planes used in this disclosure in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein disclose a sleeve construction for a garment that enables a wearer to position her hands in pockets located on each sleeve when resting. More particularly, the construction comprises a first sleeve (e.g., a right sleeve) configured to extend from a shoulder area of a wearer to a wrist area of a wearer (i.e., a long sleeve), where the first sleeve has a first pocket with a vertically oriented pocket opening in communication with a pocket space. The pocket opening is generally positioned on the front or anterior aspect of the sleeve, and the pocket space for the first pocket is configured to extend laterally across the anterior aspect of the sleeve. Moreover, the first pocket is generally positioned superior and adjacent to a midway point between the shoulder end and the wrist end of the sleeve. The construction further comprises a second sleeve (e.g., a left sleeve) also configured to extend from the shoulder area to the wrist area (i.e., a long sleeve) where the second sleeve has a second pocket with a vertically oriented pocket opening in communication with a second pocket space. The pocket opening for the second pocket is generally positioned on the medial aspect of the second sleeve, and the second pocket space is configured to extend laterally generally along a posterior or back aspect of the second sleeve. Like the first pocket, the second pocket is generally positioned superior and adjacent to a midway point between the shoulder end and the wrist end of the second sleeve.

This construction allows the wearer to, for instance, place her left hand in the first pocket on the right sleeve such that her hand generally extends across the front part of her upper arm above her elbow. The wearer can also place her right hand in the second pocket on the left sleeve such that her hand generally extends across the medial to back part of her upper arm above her elbow. The result is that the wearer's arms assume a "crossed arm" position in which the arms are crossed across the wearer's chest. This position further secures the wearer's arms against the wearer's body when resting. This position also helps to draw the wearer's elbows in toward the wearer's body which may be useful in situations where the wearer is seated in close proximity to other people (e.g., airplane seating, subway seating, train seating, and the like).

Accordingly, aspects herein disclose a garment having a sleeve construction. The garment comprises a torso covering portion defining at least a first sleeve opening, and a second sleeve opening, a first sleeve extending from the first sleeve opening, and a second sleeve extending from the second sleeve opening. Both the first and second sleeves each have a proximal end and a distal end defining a length therebetween. The first sleeve has a first pocket opening in communication with a first pocket space, where the first pocket opening is positioned on an anterior aspect of the first sleeve at a location superior to the midway point between the proximal end and the distal end of the first sleeve. The first pocket space extends in a lateral direction with respect to the first pocket opening when the garment is in the as-worn configuration. The second sleeve has a second pocket opening in communication with a second pocket space, where the second pocket opening is positioned on a medial aspect of the second sleeve at a location superior to a midway point between the proximal end and the distal end of the second sleeve. The second pocket space extends in a lateral direction with respect to the second pocket opening when the garment is in the as-worn configuration.

In another aspect, a garment having a sleeve construction is disclosed. The garment comprises a torso covering portion and a first sleeve having a proximal end extending from the torso covering portion and a distal end. The first sleeve has a first pocket comprising a first pocket opening in communication with a first pocket space, where the first pocket opening is positioned on an anterior aspect of the first sleeve at a location superior to a midway point between the proximal end and the distal end of the first sleeve. The garment further comprises a second sleeve having a proximal end extending from the torso covering portion and a distal end, where the second sleeve has a second pocket comprising a second pocket opening in communication with a second pocket space. The second pocket opening is positioned on a medial aspect of the second sleeve at a location superior to a midway point between the proximal end and the distal end of the first sleeve.

In yet another aspect, a garment having a sleeve construction is disclosed. The garment comprises a torso covering portion having a first sleeve opening and a second sleeve opening. The garment further comprises a first sleeve having a proximal end extending from the first sleeve opening and a distal end, where the first sleeve has a first pocket comprising a first pocket opening in communication with a first pocket space. The garment additionally comprises a second sleeve having a proximal end extending from the second sleeve opening and a distal end, where the second sleeve has a second pocket comprising a second pocket opening in communication with a second pocket space. Wherein, a hypothetical coronal plane divides the torso covering portion, the first sleeve, and the second sleeve into a front portion and a back portion, and the second pocket opening on the second sleeve is positioned closer to the hypothetical coronal plane as compared to the first pocket opening on the first sleeve.

As used throughout this disclosure, positional terms or points of reference such as "anterior," "posterior," "front," "back," "lateral," "medial," "superior," "inferior," "coronal," and the like are to be given their ordinary meaning with respect to the garment being worn by a hypothetical wearer standing upright with the wearer's arm positioned at their sides and with the wearer's thumbs facing forward. It is assumed that the garment is being worn as intended and as described and shown in this disclosure. When describing the sleeves and/or garment herein, the phrase "configured to cover a [specified portion] of the wearer's body," refers to sleeves and/or a garment that is appropriately sized to the particular wearer.

The terms "anterior," "posterior," "medial," and "lateral" when used to describe pocket locations on the sleeves of the garment may be construed with respect to the reference lines indicated in FIG. 1. FIG. 1 illustrates a cross section of a garment 100 and depicts a right sleeve 110, a left sleeve 112 (taken from the perspective of the wearer), and a torso covering portion 114 of a garment. For purposes of this disclosure, each of the right sleeve 110 and the left sleeve 112 may be thought of as describing a circle with 0 degrees indicating a point on each sleeve 110/112 that faces forward (e.g., North), 90 degrees indicating a point on each sleeve 110/112 that faces to the outside (away from the torso covering portion 114) (e.g., East), 180 degrees indicating a point on each sleeve 110/112 that faces back (e.g., South), and 270 degrees indicating a point on each sleeve 110/112 that faces to the inside (towards the torso covering portion 114) (e.g., West). Each of the right sleeve 110 and the left sleeve 112 can be divided into quadrants by hypothetical reference lines 116 and 118. Line 116 extends generally from about 45 degrees on each sleeve 110/112 to about 225 degrees on each sleeve 110/112, and line 118 extends generally from about 135 degrees on each sleeve 110/112 to about 315 degrees on each sleeve 110/112. As used herein, the term "about" means within ±10% of a designated value.

Continuing, the term "anterior," when used to describe a general location of each sleeve 110/112 is the quadrant between, for instance, about 45 degrees and about 315 degrees inclusive of 0 degrees; the term "lateral" when used to describe a general location on each sleeve 110/112 is the quadrant between, for example, about 45 degrees and about 135 degrees inclusive of 90 degrees; the term "posterior" when used to describe a general location on each sleeve 110/112 is the quadrant between, for instance, about 135 degrees and about 225 degrees inclusive of 180 degrees; and the term "medial" when used to describe a general location on each sleeve 110/112 is the quadrant between, for example, about 225 degrees and about 315 degrees inclusive of 270 degrees. These measurements are not meant to be exact but to provide general ranges. For example, the quadrants described herein may vary by ±5 degrees, 10 degrees, up to 15 degrees.

With further respect to FIG. 1, the torso covering portion 114 and the right and left sleeves 110/112 can be divided into front (anterior) and back (posterior) halves by a hypothetical coronal plane 120. To describe it another way, the hypothetical coronal plane 120 passes through each of the right and left sleeves 110/112 at about 270 degrees and about 90 degrees.

Figure 2:
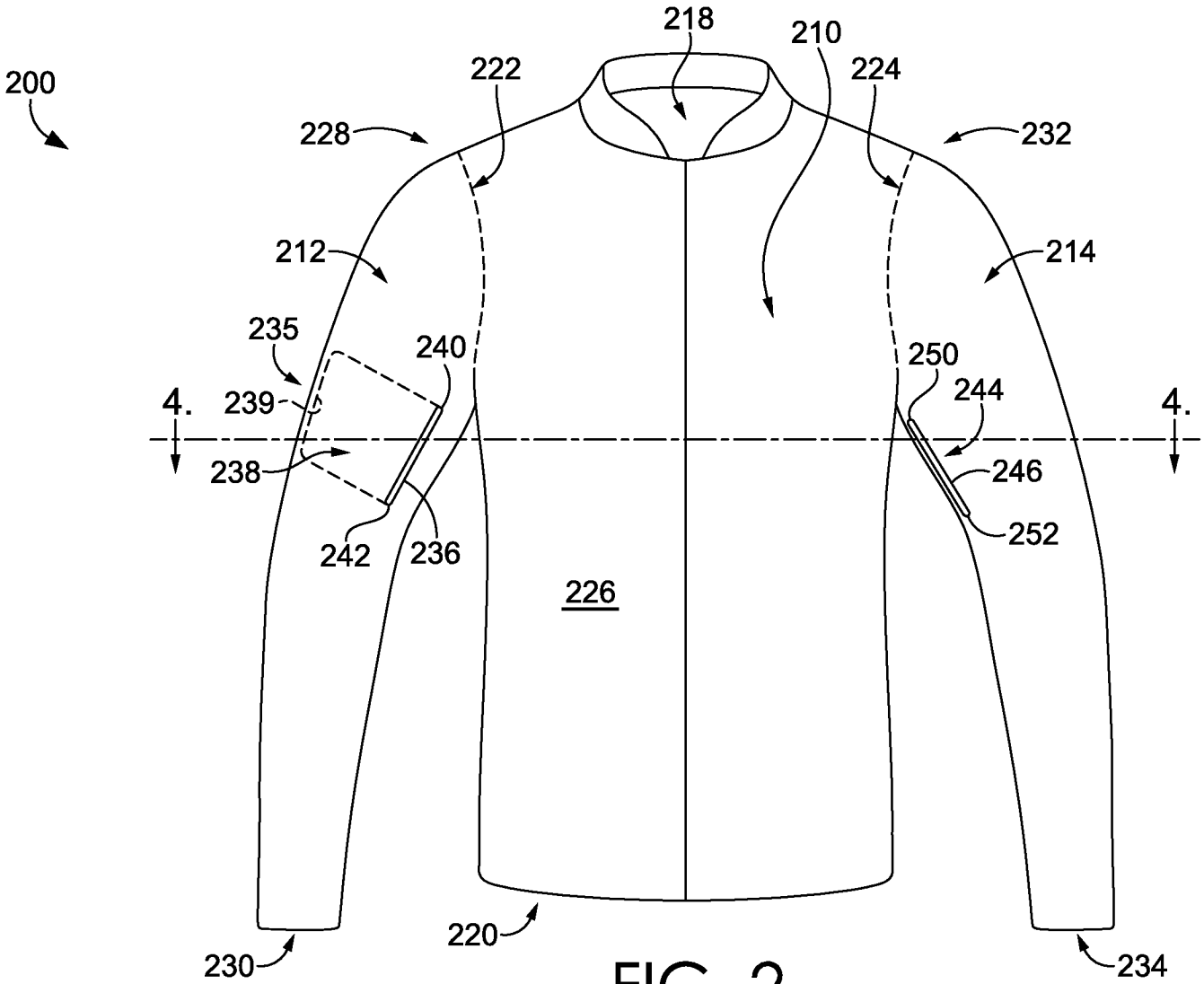
FIG. 2 illustrates a front view of a garment having an exemplary sleeve construction in accordance with aspects herein.
Figure 3:
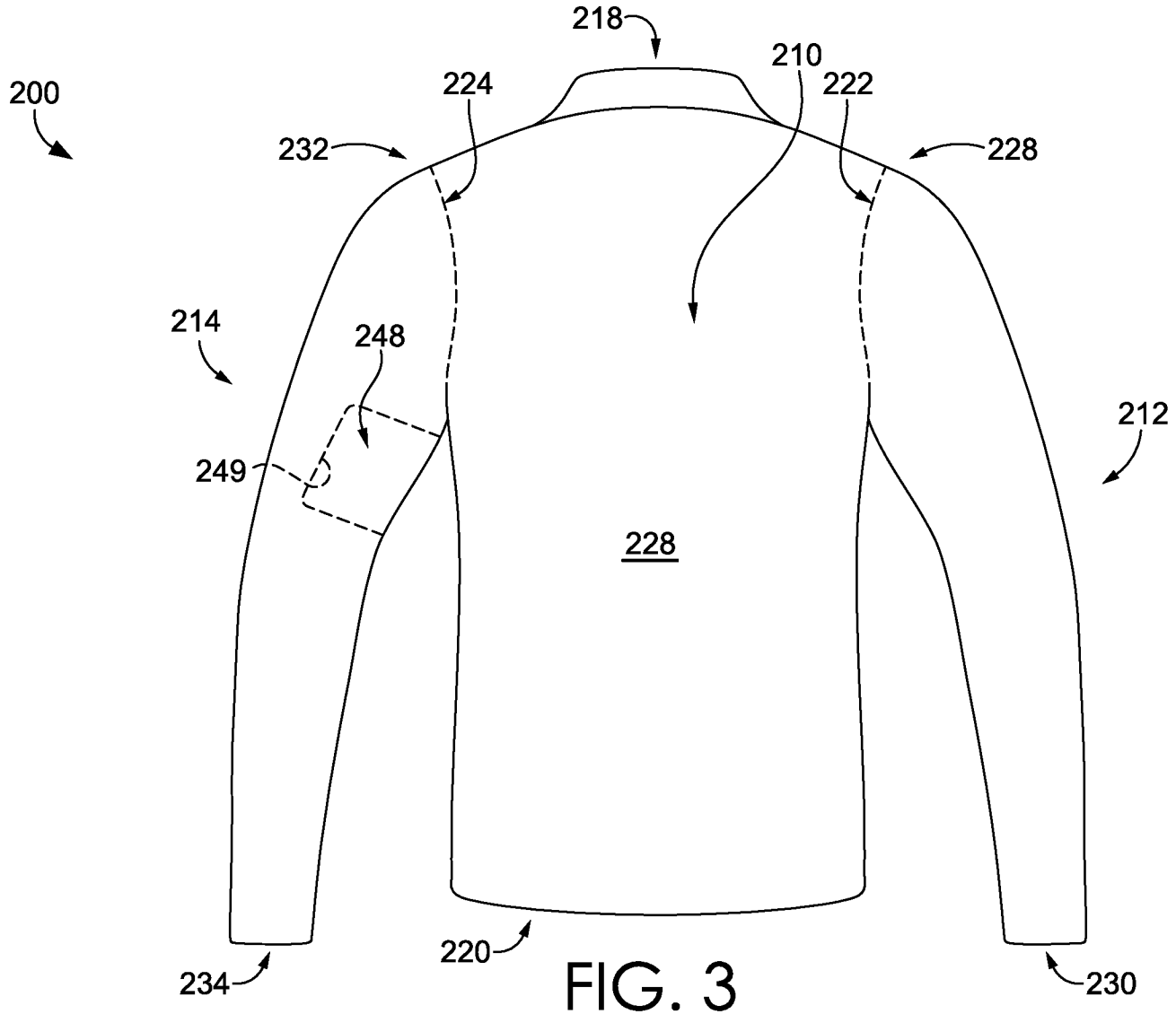
FIG. 3 illustrates a back view of the garment of FIG. 1 in accordance with aspects herein.

With this as a reference, FIGS. 2 and 3 illustrate front and back views respectively of a garment 200 having a torso covering portion 210, a first sleeve 212 extending from the torso covering portion 210, and a second sleeve 214 extending from an opposite side of the torso covering portion 216. In exemplary aspects, the torso covering portion 210 is configured to cover a front and back torso area of a wearer when the garment 200 is in the as-worn configuration. The torso covering portion 210 defines at least a neckline opening 218, a waist opening 220, a first sleeve opening 222 (shown by dashed lines), and a second sleeve opening 224 (also shown be dashed lines). Although shown as a jacket with a closure mechanism extending along the front, it is contemplated herein that the torso covering portion 210 may be in the form of a pullover, a hoodie, a button-up, a half-zip, and the like. As described with respect to FIG. 1, the torso covering portion 210 may be divided into a front portion 226 (shown in FIG. 2) and a back portion 228 (shown in FIG. 3) by a hypothetical coronal plane.

The first sleeve 212 (which may also be known herein as a right sleeve 212) comprises a proximal end 228 and a distal end 230 defining a length therebetween. The proximal end 228 extends from the first sleeve opening 222 of the torso covering portion 210. Similarly, the second sleeve 214 (which may also be known herein as a left sleeve 214) comprises a proximal end 232 and a distal end 234 defining a length therebetween. The proximal end 232 of the second sleeve 214 extends from the second sleeve opening 224 of the torso covering portion 210. The term "extends" as used herein may mean that the sleeves 212/214 integrally extend from the torso covering portion 210 without joining seams, but it may also mean that the sleeves 212/214 are affixed to the sleeve openings 222/224 through one or more joining seams. Any and all aspects, and any variation thereof, are contemplated as being within the scope herein.

It is contemplated herein that both the first and second sleeves 212/214 may comprise "long" sleeves. In other words, when worn by a wearer appropriately sized for the garment 200, the first and second sleeves 212/214 are configured to extend from a shoulder area of the wearer to a wrist area of the wearer. To describe it a different way, the proximal end 228 of the first sleeve 212 and the proximal end 232 of the second sleeve 214 are configured to be positioned generally adjacent to a shoulder area of the wearer, and the distal end 230 of the first sleeve 212 and the distal end 234 of the second sleeve 214 are configured to be positioned generally adjacent a wrist area of the wearer.

In exemplary aspects, the first and second sleeves 212/214 and/or the torso covering portion 210 of the garment 200 may be formed from a low-stretch material. As used herein, the term "low-stretch" may mean a material that does not incorporate elastic yarns. However, these materials may still exhibit some degree of mechanical stretch due to the particular knitting or weaving process used to form the material. It is also contemplated herein that the first and second sleeves 212/214 and/or the torso covering portion 210 of the garment 200 may be formed of a stretch material incorporating one or more elastic yarns. Any and all aspects, and any variation thereof, are contemplated as being within the scope herein.

Further, in exemplary aspects, the first and second sleeves 212/214 and/or the torso covering portion 210 of the garment 100 may be formed of a material configured to provide warmth or insulation when worn. For instance, the first and second sleeves 212/214 and/or the torso covering portion 210 may be formed of a spacer mesh material that may trap air between the inner and outer layers to help insulate the wearer when the garment 200 is worn.

With respect to the front view of the garment 200 shown in FIG. 2, in exemplary aspects the first sleeve 212 comprises a pocket 235 having a pocket opening 236 in communication with a pocket space 238 (shown by dashed lines to indicate that the pocket space 238 is hidden from view). The pocket opening 236 comprises a superior end 240 and an inferior end 242, where the superior end 240 is positioned superior to the inferior end 242. In exemplary aspects, the pocket opening 236 may be formed by incising the material used to form the first sleeve 212. And the pocket space 238 may be formed by coupling a layer of material to an inner-facing surface of the first sleeve 212 such that the pocket 235 is hidden from view except for the pocket opening 236. Other ways of forming the pocket 235 are contemplated herein. For example, the pocket opening 236 may be integrally formed via a knitting or weaving process used to form the first sleeve 212. For instance, the pocket space 238 may be formed by knitting or weaving a two-layer construction in the area where the pocket space 238 is positioned. Any and all aspects, and any variation thereof, are contemplated as being within aspects herein.

Continuing, in exemplary aspects the pocket opening 236 is oriented in a generally vertical direction and is located at an area generally superior and adjacent to a midway point between the proximal end 228 and the distal end 230 of the first sleeve 212. As used herein, the term "adjacent" may mean within about 1.0 cm to about 10 cm of a designated reference point. To describe the location of the pocket opening 236 a different way, the inferior end 242 of the pocket opening 236 may be positioned above or superior to an elbow area of the first sleeve 212, where the elbow area comprises the area of the first sleeve 212 that bends or flexes when a wearer bends her arm at the elbow. In general, the elbow area comprises the approximate midway point between the proximal end 228 and the distal end 230 of the first sleeve 212. With reference to FIG. 1, the pocket opening 236 may be positioned on an anterior aspect of the first sleeve 212. The pocket space 238 extends laterally away from the pocket opening 236 and is positioned on at least the anterior aspect of the first sleeve 212. It is contemplated herein, that the pocket space 238 may further extend on to the lateral aspect of the first sleeve 212 before terminating. Similar to the pocket opening 236, the pocket space 238 may also be positioned at an area superior and adjacent to the midway point between the proximal end 228 and the distal end 230 of the first sleeve 212.

With continued reference to FIG. 2 and with reference to FIG. 3, the second sleeve 214 may comprise a pocket 244 having a pocket opening 246 in communication with a pocket space 248 (seen in the back view of FIG. 3 and shown by dashed lines to indicate that the pocket space 248 is hidden from view). The pocket opening 246 comprises a superior end 250 and an inferior end 252, where the superior end 250 is positioned superior to the inferior end 252. Similar to the pocket 235, the pocket opening 246 may be formed by incising the material used to form the second sleeve 214, and the pocket space 248 may be formed by coupling a layer of material to an inner-facing surface of the second sleeve 214 such that the pocket 244 is hidden from view except for the pocket opening 246. Also similar to the pocket 235, other ways of forming the pocket 244 are contemplated herein such as by modifying a knitting or weaving process used to form the second sleeve 214 to create the pocket opening 246 and the pocket space 248. Any and all aspects, and any variation thereof, are contemplated as being within aspects herein.

Continuing, in exemplary aspects the pocket opening 246 is generally oriented in a vertical direction and is located at an area generally superior and adjacent to a midway point between the proximal end 232 and the distal end 234 of the second sleeve 214. To describe the location of the pocket opening 246 a different way, the inferior end 252 of the pocket opening 246 may be positioned above or superior to an elbow area of the second sleeve 214, where the elbow area comprises the approximate midway point between the proximal end 232 and the distal end 234 of the second sleeve 214. With reference to FIG. 1, the pocket opening 246 may be positioned on a medial aspect of the second sleeve 214. The pocket space 248 extends laterally away from the pocket opening 246 and is positioned on at least the medial and posterior aspect of the second sleeve 214. For instance, the pocket space 248 may terminate on the posterior aspect of the second sleeve 214, at a second single pocket terminating end 249. Similar to the pocket opening 246, the pocket space 248 may also be positioned at an area generally superior and adjacent to the midway point between the proximal end 232 and the distal end 234 of the second sleeve 214.

Figure 4:
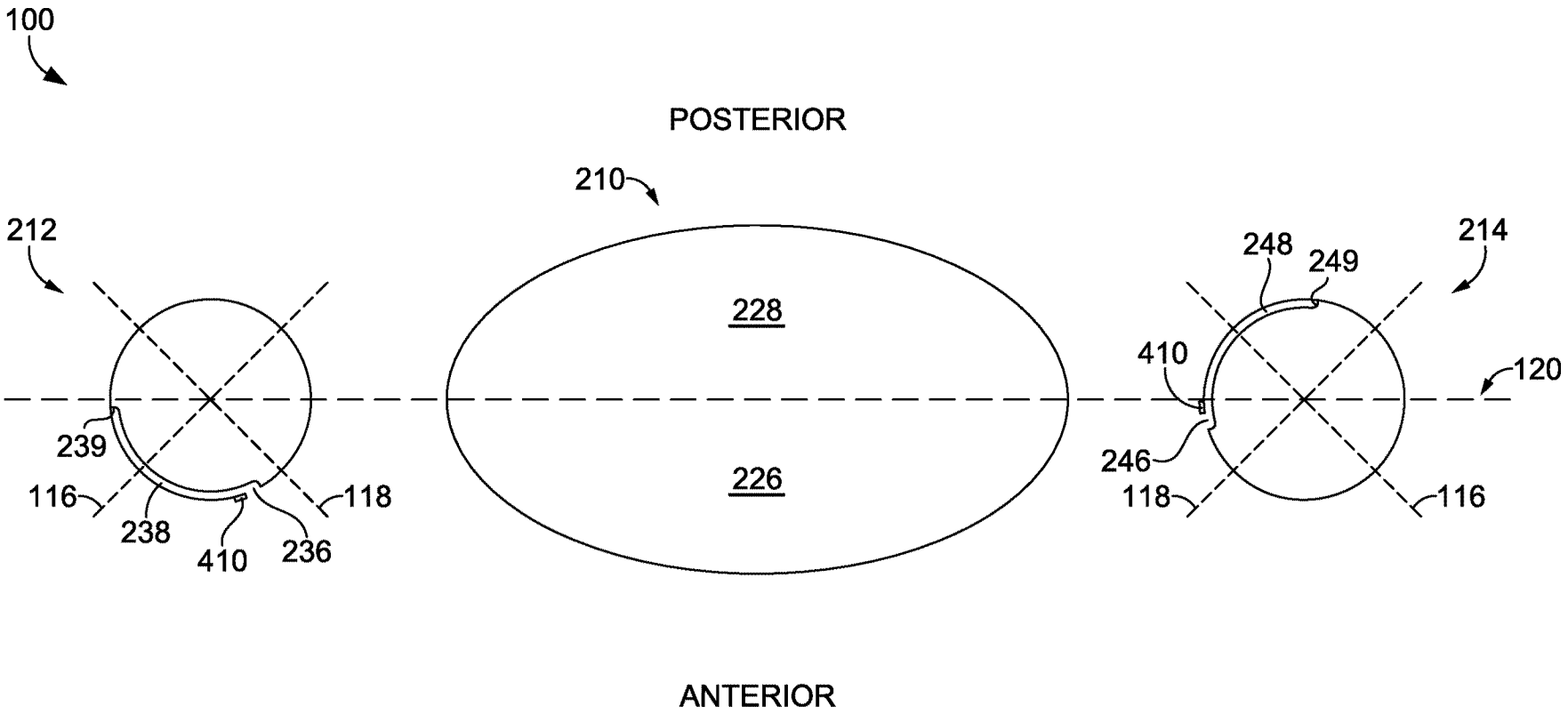
FIG. 4 illustrates a cross-sectional view taken along cut line 4-4 of FIG. 2 in accordance with aspects herein.

FIG. 4 is a cross-sectional view of the garment 200 taken along cut line 4-4 of FIG. 2 in accordance with aspects herein. The cross-sectional view of FIG. 4 further illustrates the hypothetical coronal plane 120 of FIG. 1 that may be thought of as dividing the garment 200 into the front (anterior) portion 226 and the back (posterior) portion 228. The hypothetical coronal plane 120 may also be thought of as dividing the first and second sleeves 212/214 into a front (anterior) half and a back (posterior) half. The reference lines 116 and 118 of FIG. 1 are also shown in FIG. 4.

With respect to the first sleeve 212, the pocket opening 236 is shown as being positioned on the anterior aspect of the first sleeve 212 with respect to the reference lines 116 and 118. In exemplary aspects, at least one edge of the pocket opening 236 may be reinforced with a stiffening material 410 to provide additional structure to the opening 236. Exemplary stiffening materials may comprise boning, fabric, plastic, thermoplastic polyurethane, metal, and the like. The pocket space 238 is shown extending laterally across the anterior aspect of the first sleeve 212 and terminating on the lateral aspect of the first sleeve 212, at a first single pocket terminating end 239.

With respect to the second sleeve 214, the pocket opening 246 is shown as being positioned on the medial aspect of the second sleeve 214. In exemplary aspects, at least one edge of the pocket opening 246 may be reinforced with the stiffening material 410. The pocket space 248 extends laterally away from the pocket opening 246 across the medial aspect of the second sleeve 214 and terminates on the posterior aspect of the second sleeve 214.

To describe the pocket openings 236 and 246 a different way, each of the pocket opening 236 and the pocket opening 246 is positioned anterior to the hypothetical coronal plane 120. However, the pocket opening 246 on the second sleeve 214 is positioned closer to the hypothetical coronal plane 120 compared to the pocket opening 236 on the first sleeve 212.

The configuration of the pockets 235 and 244 on the first and second sleeves 212 and 214 respectively is exemplary only. For instance, the pocket 235 may be located on the second sleeve 214, and the pocket 244 may be located on the first sleeve 212. Any and all aspects are contemplated as being within the scope herein.

Figure 6:
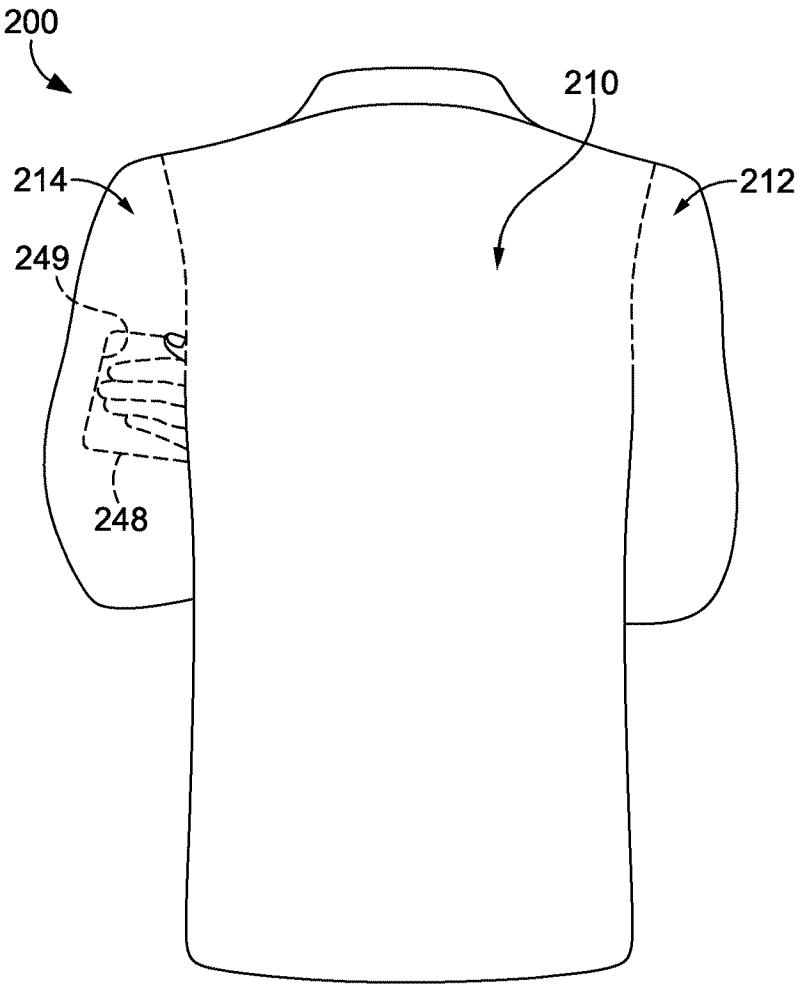
FIG. 6 illustrates a back view of the garment of FIGS. 2-3 in an in-use configuration in accordance with aspects herein.
Figure 5:
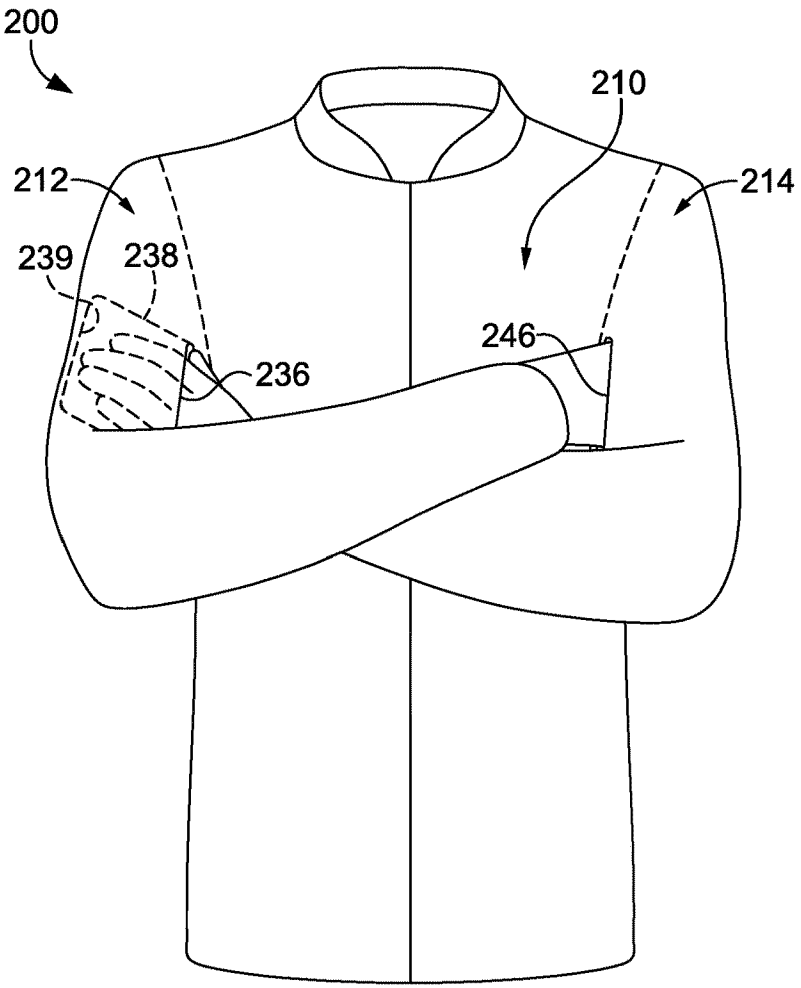
FIG. 5 illustrates a front view of the garment of FIGS. 2-3 in an in-use configuration in accordance with aspects herein.

The placement of the pocket openings 236 and 246 and the pocket spaces 238 and 248 serves several functional advantages. For instance, by positioning the inferior ends 242/252 of the pocket openings 236/246 generally superior to the elbow area of the first and second sleeves 212/214, a wearer can freely bend his or her arms without interference from the openings 236/246. This may be especially useful when the pocket opening edges are reinforced with a stiffening material such as the stiffening material 410. The configuration of the pockets 235 and 244 also enables a wearer to position his or her hands and arms in a "crossed arm" position over the wearer's chest. This aspect is shown in FIGS. 5 and 6. FIGS. 5 and 6 illustrate front and back views respectively of the garment 200 being worn by a wearer 510 in accordance with aspects herein. In situations where the wearer 510 wishes to rest or nap, the wearer can place his left hand into the pocket space 238 of the first sleeve 212 via the pocket opening 236, and the wearer 510 can place his right hand into the pocket space 248 of the second sleeve 214 via the pocket opening 246 (best seen in FIG. 6). Once the wearer's left hand is inserted into the pocket space 238 of the first sleeve 212, the wearer's hand can curve around the anterior and lateral aspect of the wearer's upper arm. And once the wearer's right hand is inserted into the pocket space 248 of the second sleeve 214, the wearer's hand can tuck behind the posterior aspect of the wearer's upper arm (best seen in FIG. 6). The result is a configuration where the wearer's arms are crossed against the wearer's chest as shown in FIG. 5. As explained above, the configuration of the pockets 235 and 244 may be reversed such that the configuration enables a wearer to cross her left arm over her right arm instead of vice versa. Any and all aspects are contemplated herein.

This "crossed arm" position caused by the sleeve configuration of the garment 200 may provide certain advantages. For example, this position helps to "lock" the wearer's arms into a secure position by allowing the wearer's hands, when inserted into the pockets 235 and 244, to rest against the wearer's forearms. This position also helps to draw the wearer's elbows in towards the wearer's body. This may be useful in cramped spaces such as on airplanes, trains, subways, and the like. Both of these benefits may provide a feeling of comfort and security to the wearer allowing the wearer to rest or even nap when, for example, traveling.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A garment having a sleeve construction, the garment comprising:

a torso covering portion defining at least a first sleeve opening, and a second sleeve opening;

a first sleeve extending from the first sleeve opening, the first sleeve divided into an anterior half and a posterior half; and a second sleeve extending from the second sleeve opening, the second sleeve divided into an anterior half and a posterior half, the first sleeve and the second sleeve each having a proximal end and a distal end defining a length therebetween, wherein:

the first sleeve consists of a first single pocket opening in communication with a first single pocket space, and a first single pocket terminating end, the first single pocket opening and the first single pocket terminating end each positioned on the anterior half of the first sleeve at a location superior to a midway point between the proximal end and the distal end of the first sleeve, the first single pocket space extending in a lateral direction with respect to the first single pocket opening, and the second sleeve consists of a second single pocket opening in communication with a second single pocket space, and a second single pocket terminating end, the second single pocket opening positioned on the anterior half of the second sleeve, and the second single pocket terminating end positioned on the posterior half of the second sleeve at a location superior to a midway point between the proximal end and the distal end of the second sleeve, the second single pocket space extending in a lateral direction with respect to the second single pocket opening.

2. The garment of claim 1, wherein the first sleeve and the second sleeve comprise long sleeves.

3. The garment of claim 1, wherein the first sleeve and the second sleeve are formed from a low-stretch material.

4. The garment of claim 1, wherein the first single pocket opening and the second single pocket opening are reinforced with a stiffening material.

5. The garment of claim 1, wherein the first single pocket opening and the second single pocket opening are vertically oriented.

6. The garment of claim 5, wherein both the first single pocket opening and the second single pocket opening comprise a first end and a second end with the first single pocket opening and the second single pocket opening extending therebetween, and wherein the first end is positioned superior to the second end.

7. The garment of claim 6, wherein the second end of the first single pocket opening and the second end of the second single pocket opening are both located adjacent to the midway point of the first sleeve and the second sleeve respectively.

8. The garment of claim 1, wherein the first single pocket space extends across the anterior half of the first sleeve.

9. The garment of claim 8, wherein the second single pocket space extends across a posterior half of the second sleeve.

10. A garment having a sleeve construction, the garment comprising:

a torso covering portion;

a first sleeve having a proximal end extending from the torso covering portion and a distal end, the first sleeve divided into an anterior half and a posterior half, the first sleeve consisting of a first single pocket comprising a first single pocket opening in communication with a first single pocket space, and a first single pocket terminating end, the first single pocket opening and the first single pocket terminating end each positioned on the anterior half of the first sleeve at a location superior to a midway point between the proximal end and the distal end of the first sleeve; and a second sleeve having a proximal end extending from the torso covering portion and a distal end, the second sleeve divided into an anterior half and a posterior half, the second sleeve consisting of a second single pocket comprising a second single pocket opening in communication with a second single pocket space, and a second single pocket terminating end, the second single pocket opening positioned on the anterior half of the second sleeve, and the second single pocket terminating end positioned on the posterior half of the second sleeve, the second single pocket opening and the second single pocket terminating end each positioned at a location superior to a midway point between the proximal end and the distal end of the second sleeve.

11. The garment of claim 10, wherein both the first single pocket opening and the second single pocket opening are vertically oriented.

12. The garment of claim 11, wherein the first single pocket space extends across the anterior half of the first sleeve, and wherein the second single pocket space extends across a posterior half of the second sleeve.

13. A garment having a sleeve construction, the garment comprising:

a torso covering portion having a first sleeve opening and a second sleeve opening;

a first sleeve having a proximal end extending from the first sleeve opening and a distal end, the first sleeve divided into an anterior half and a posterior half, the first sleeve consisting of a first single pocket comprising a first single pocket opening in communication with a first single pocket space, and a first single pocket terminating end; and a second sleeve having a proximal end extending from the second sleeve opening and a distal end, the second sleeve divided into an anterior half and a posterior half, the second sleeve consisting of a second single pocket comprising a second single pocket opening in communication with a second single pocket space, and a second single pocket terminating end, wherein:

the first single pocket opening and the first single pocket terminating end are each positioned on the anterior half of the first sleeve at a location superior to a midway point between the proximal end and the distal end of the first sleeve; and the second single pocket opening is positioned on the anterior half of the second sleeve, and the second single pocket terminating end is positioned on the posterior half of the second sleeve at a location superior to a midway point between the proximal end and the distal end of the second sleeve.

14. The garment of claim 13, wherein the first single pocket space extends across the anterior half of the first sleeve.

15. The garment of claim 13, wherein the second single pocket space extends across a posterior half of the second sleeve.

16. The garment of claim 13, wherein the first sleeve and the second sleeve are formed from a low-stretch material.

* * * * *